US010895123B2

(12) United States Patent
Ezell

(10) Patent No.: US 10,895,123 B2
(45) Date of Patent: Jan. 19, 2021

(54) HYDROSTATICALLY ACTUABLE DOWNHOLE PISTON

(71) Applicant: HALLIBURTON ENERGY SERVICES INC., Houston, TX (US)

(72) Inventor: Michael Dale Ezell, Cassville, MO (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/575,127

(22) PCT Filed: Jul. 7, 2015

(86) PCT No.: PCT/US2015/039399
§ 371 (c)(1),
(2) Date: Nov. 17, 2017

(87) PCT Pub. No.: WO2017/007459
PCT Pub. Date: Jan. 12, 2017

(65) Prior Publication Data

US 2018/0142526 A1 May 24, 2018

(51) Int. Cl.

| | |
|---|---|
| ***E21B 23/04*** | (2006.01) |
| ***E21B 23/06*** | (2006.01) |
| ***E21B 33/128*** | (2006.01) |
| ***E21B 33/1295*** | (2006.01) |
| ***E21B 23/00*** | (2006.01) |

(Continued)

(52) U.S. Cl.
CPC ..... *E21B 23/04* (2013.01); *E21B 23/06* (2013.01); *E21B 33/1285* (2013.01); *E21B 33/1295* (2013.01)

(58) Field of Classification Search
CPC ..... E21B 23/04; E21B 23/06; E21B 23/00; E21B 23/08
See application file for complete search history.

(56) References Cited

U.S. PATENT DOCUMENTS

| | | | |
|---|---|---|---|
| 4,284,137 | A | 8/1981 | Taylor |
| 2001/0013415 | A1 | 8/2001 | Mullen et al. |

(Continued)

FOREIGN PATENT DOCUMENTS

| | | | |
|---|---|---|---|
| EP | 0237662 | B1 | 5/1990 |
| WO | 2014007794 | A1 | 1/2014 |
| WO | 2014109752 | A1 | 7/2014 |

OTHER PUBLICATIONS

International Search Report and Written Opinion; PCT Application No. PCT/US2015/039399; dated Feb. 25, 2016.

(Continued)

*Primary Examiner* — Tara Schimpf
*Assistant Examiner* — Manuel C Portocarrero
(74) *Attorney, Agent, or Firm* — Polsinelli PC

(57) ABSTRACT

A hydrostatically actuable downhole piston apparatus for use in a wellbore, comprising glide spacers disposed in the primary chamber, capable of mitigating the deflection of the piston and other hydrostatic components at elevated wellbore hydrostatic pressures. The disclosed apparatus is suited for, among other applications, the hydrostatic setting of a downhole tool, such as a packer, in a wellbore. A method and system for hydrostatically setting a downhole tool using glide spacers disposed in the primary chamber of the downhole tool.

22 Claims, 10 Drawing Sheets

(51) Int. Cl.

| | |
|---|---|
| ***E21B 23/08*** | (2006.01) |
| ***E21B 19/16*** | (2006.01) |
| ***E21B 34/10*** | (2006.01) |
| ***E21B 34/14*** | (2006.01) |

(56) References Cited

U.S. PATENT DOCUMENTS

| | | | | |
|---|---|---|---|---|
| 2004/0216868 | A1 | 11/2004 | Owen | |
| 2011/0108285 | A1 | 5/2011 | Fagley, IV et al. | |
| 2011/0203790 | A1* | 8/2011 | Carstensen | E21B 17/042 166/242.6 |
| 2012/0090854 | A1* | 4/2012 | Ringgenberg | E21B 17/00 166/382 |
| 2012/0186829 | A1 | 7/2012 | Watson | |
| 2012/0260999 | A1* | 10/2012 | Brandsdal | E21B 34/10 137/14 |
| 2013/0043040 | A1 | 2/2013 | Fay | |

OTHER PUBLICATIONS

Search Report and Written Opinion; Singapore Application No. 11201709873V; dated Mar. 12, 2019.

Examination Report, Australian Application No. 2015401564; dated Jun. 26, 2020.

* cited by examiner

HYDROSTATICALLY ACTUABLE DOWNHOLE PISTON

CROSS-REFERENCE TO RELATED APPLICATIONS

This application is a national stage entry of PCT/US2015/039399 filed Jul. 7, 2015, said application is expressly incorporated herein in its entirety.

FIELD

The present technology relates to hydrostatically actuable pistons used in subterranean wellbores. In particular, the present disclosure relates to hydrostatically actuable pistons operable at elevated hydrostatic pressures.

BACKGROUND

A hydrostatically actuable downhole piston apparatus may be suitably employed in a variety of wellbore tools, including for example packers. Wellbores are drilled into the earth for a variety of purposes including tapping into hydrocarbon bearing formations to extract the hydrocarbons for use as fuel, lubricants, chemical production, and other purposes. When a wellbore has been completed, a metal tubular casing may be placed and cemented in the wellbore. In the process of treating and preparing a subterranean well for production, packers are commonly run into the well on a conveyance such as a work string or production tubing. The purpose of the packer is to support production tubing and other completion equipment by sealing the annulus between the outside of the production tubing and inside of the well casing to block movement of fluids through the annulus past the packer location.

Production packers and other types of downhole tools may be run down on production tubing to a desired depth in the wellbore before they are set. Hydrostatically-actuated downhole tools may be set by a mechanism that involves actuating a piston in response to hydrostatic pressure within production tubing, casing or wellbore. The setting force being generated by applied surface pressure and/or the natural hydrostatic pressure associated with the fluid column in the wellbore.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which:

FIG. 2 is not drawn to scale, rather, FIG. 2 is exaggerated in the horizontal direction.

FIG. 3A is not drawn to scale, rather, FIG. 3A is exaggerated in the horizontal direction.

FIG. 3B is not drawn to scale, rather, FIG. 3B is exaggerated in the horizontal direction.

FIG. 6A is not drawn to scale, rather, FIG. 6A is exaggerated in the horizontal direction.

FIG. 6B is not drawn to scale, rather, FIG. 6B is exaggerated in the horizontal direction.

DETAILED DESCRIPTION

Figure 1:
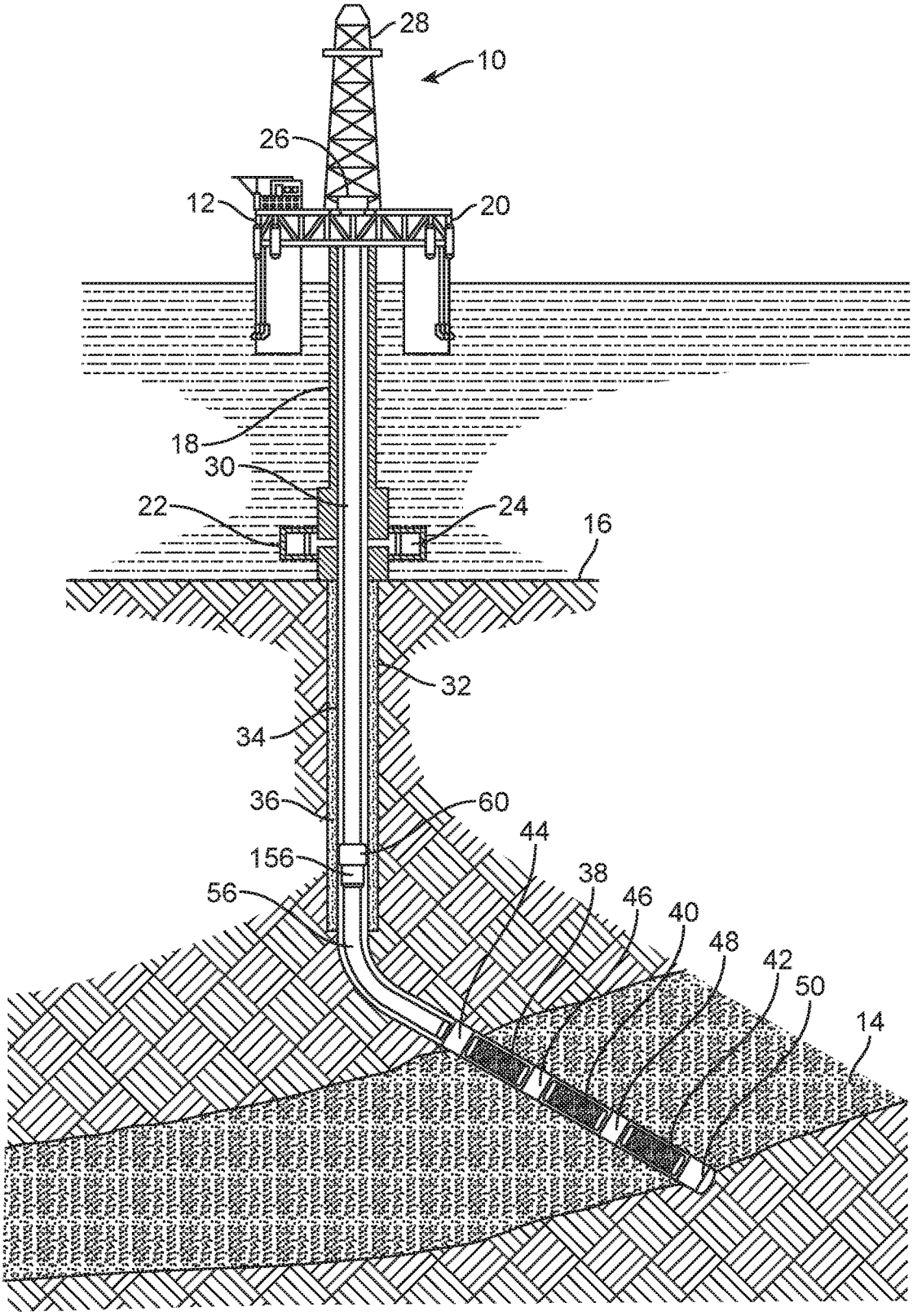
FIG. 1 is a schematic diagram of an embodiment of a wellbore operating environment in which a downhole tool including a hydrostatically actuable downhole piston, such as a packer, may be deployed.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed apparatus, methods, and systems may be implemented using any number of techniques. The disclosure should in no way be limited to the illustrative implementations, drawings, and techniques illustrated herein, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and also may include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "uphole" meaning toward the surface of the wellbore and with "down," "lower," "downward," "downstream," or "downhole" meaning toward the terminal end of the well, regardless of the wellbore orientation. The various characteristics described in more detail below, will be readily apparent to those skilled in the art with the aid of this disclosure upon reading the following detailed description, and by referring to the accompanying drawings.

Description

Disclosed herein is a hydrostatically actuable downhole piston apparatus which may be used in a variety of wellbore tools. One use of a hydrostatically actuable downhole piston apparatus may be as part of a hydrostatic setting system. Downhole tools may be set in the wellbore using a hydrostatic setting system that relies on the differential pressure between the downhole hydrostatic pressure and a pressure within a piston's chamber to actuate a piston which in turn sets the tool. One application of this system is the setting of a packer downhole. The hydrostatically actuable downhole piston apparatus may be suitably employed in shifting sleeves, releasing locking mechanisms as well as other tools.

In particular, the hydrostatic setting system may include a piston that is exposed on one side to an initiation chamber, which is initially closed off to the wellbore annulus fluid by a port isolation device, while the piston is exposed on the other side to a primary chamber. Both the initiation chamber and the primary chamber may be at atmospheric pressure or may be evacuated by pulling a vacuum. Once the downhole tool is positioned at the desired setting depth, pressure may be applied to the production tubing and the wellbore annulus until the port isolation device actuates, thereby allowing wellbore fluid to enter the initiation chamber on one side of the piston while the chamber engaging the other side of the piston remains at atmospheric or evacuated pressure. This creates a differential pressure across the piston that causes the piston to move, initiating the setting process. Once the setting process initiates, O-rings in the initiation chamber may move off seat to open a larger flow area, and the fluid entering the initiation chamber continues actuating the piston to complete the setting process. In the case of a packer, actuation of the piston exerts an upward setting force on the packer thereby driving the packer sealing elements to engage the casing. In other examples, rather than increasing pressure from the surface to actuate the piston, a collet can be used to fix the piston in place, which can then be released, thereby permitting the piston to move due to hydrostatic pressure present in the wellbore.

Typically, as a downhole tool is run downhole, the hydrostatic setting system is exposed to increasing hydrostatic pressure. The increasing hydrostatic pressure may cause deflection of the outer and inner components of the setting system as the differential pressure between the wellbore and the atmospheric chamber of the hydrostatic setting system increases. At higher wellbore pressures deflection of the components around the atmospheric chamber may eventually cause the piston to seize up and inhibit the axial movement of the setting piston.

The present disclosure describes a hydrostatically actuable downhole piston apparatus, method, and system comprising glide spacers disposed in the atmospheric chamber which mitigate the deflection of hydrostatic setting system components and allow free movement of the piston components at elevated hydrostatic pressures.

FIG. 1 illustrates a schematic view of an embodiment of a wellbore operating environment in which a downhole tool including a hydrostatically actuable downhole piston apparatus, such as a packer, may be deployed. As depicted, an offshore oil or gas well 10 may include a semi-submersible platform 12 centered over a submerged oil and gas formation 14 located below the sea floor 16. A subsea conduit 18 extends from the deck 20 of the platform 12 to a wellhead installation 22, including blowout preventers 24. The platform 12 has a hoisting apparatus 26 and a derrick 28 for raising and lowering pipe strings, such as substantially tubular, longitudinally extending inner work string 30. The wellbore 32 extends through the various earth strata including formation 14. A casing 34 is cemented within a vertical section of wellbore 32 by cement 36. An upper end of a liner 56 is secured to the lower end of the casing 34 by any means known in the art, such as expandable liner hangers, and the like.

Note that, in this specification, the terms "liner" and "casing" are used interchangeably to describe tubular materials, which are used to form protective linings in wellbores. It is not necessary for a liner or casing to be cemented in a wellbore. Any type of liner or casing may be used in keeping with the present disclosure.

The liner 56 may include one or more packers 44, 46, 48, 50, 60 that may be located proximal to the top of the liner 56 or at a lower portion of the liner 56 that provide zonal isolation to the production of hydrocarbons to certain zones of liner 56. Packers 44, 46, 48, 50, and 60 may include and be actuated by the hydrostatically actuable downhole piston apparatus, method, and system of the present disclosure. When set, packers 44, 46, 48, 50, and 60 isolate zones of the annulus between wellbore 32 and casing 34 in between packers 44, 46, between packers 46, 48, and between packers 48, 50. As shown in FIG. 1, any number of packers may be simultaneously or sequentially run and deployed, such as packers 44, 46, 48, 50, 60.

Additionally, liner 56 includes sand control screen assemblies 38, 40, and 42 that are located near the lower end of the liner 56 and substantially proximal to the formation 14. As shown, packers 44, 46, 48, and 50 may be located above and below each set of sand control screen assemblies 38, 40, and 42. Although in the exemplary embodiment, packers are illustrated, the hydrostatically actuable downhole piston apparatus can be employed in other tools and mechanisms as well.

Although FIG. 1 depicts a slanted well, it should be understood by one skilled in the art that the present disclosure describing a hydrostatically actuable downhole piston apparatus, method, and system is equally well-suited for use in vertical wells, horizontal wells, multilateral wells, and the like. Also, although FIG. 1 depicts an offshore operation, it should be understood by one skilled in the art that the present disclosure is equally well-suited for use in onshore operations. Additionally, although FIG. 1 depicts sand control screen assemblies, it should be understood by one skilled in the art that the present disclosure is equally well-suited for use in the absence of sand control screen assemblies.

Figure 2:
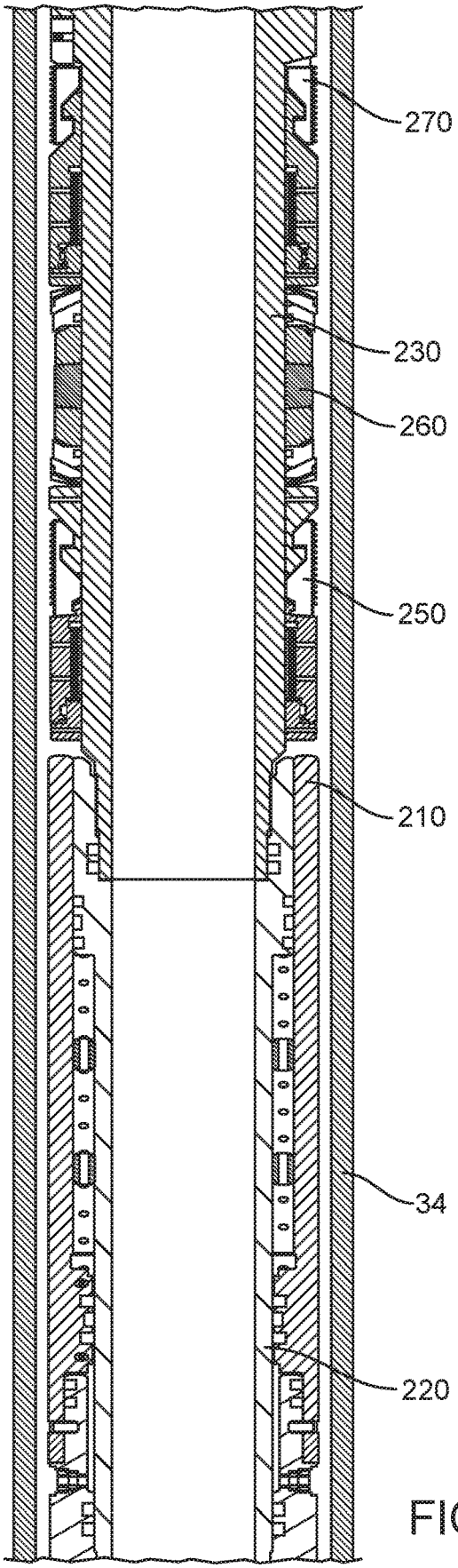
FIG. 2 is a sectional view of an embodiment of a packer including a hydrostatically actuable downhole piston apparatus in the run configuration.

FIG. 2 illustrates a sectional view of an embodiment of a packer including a hydrostatically actuable downhole piston apparatus in the run position. The hydrostatically actuable downhole piston is set in the run position while the packer is being run into the wellbore and prior to setting the packer at the desired wellbore depth. The packer includes a hydrostatically actuable piston 210 that is slidably disposed about a hydrostatic mandrel 220. The hydrostatic mandrel 220 is coupled to a packer mandrel 230. Disposed on the packer mandrel 230 are several packer elements, including the lower slip assembly 250, upper slip assembly 270, and seal assembly 260. In the run position, the hydrostatically actuable piston 210 is spaced apart from the packer mandrel 230 and packer elements, including the lower slip assembly 250.

Figure 3A:
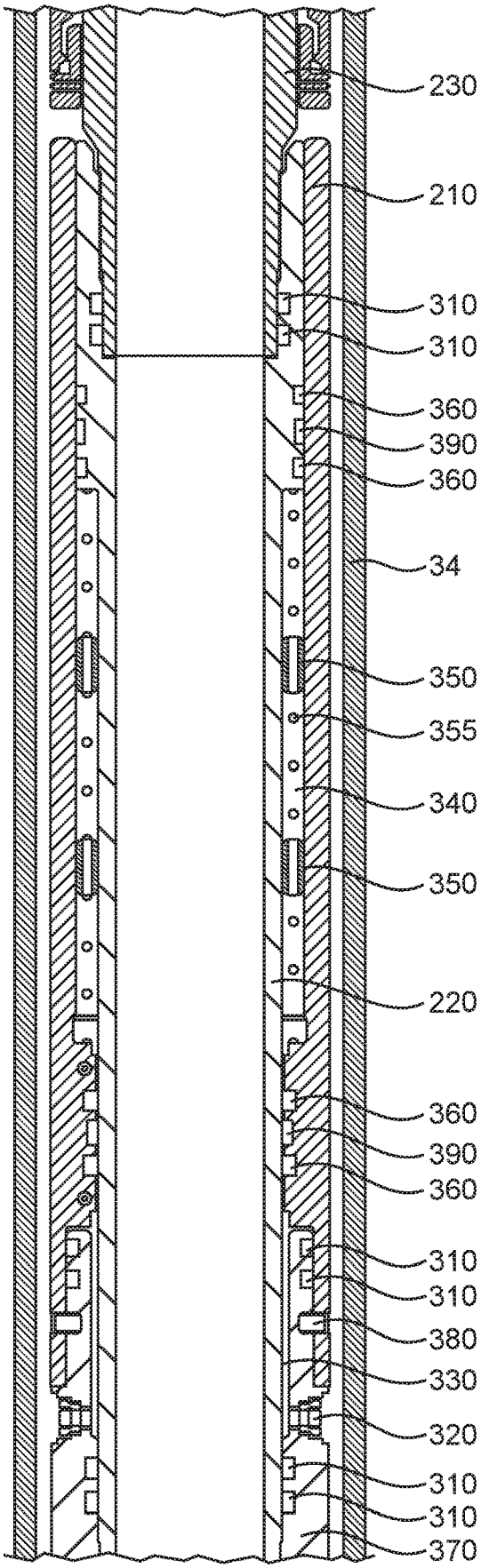
FIG. 3A is a close-up view of FIG. 2 focusing on the chamber portion of the hydrostatically actuable downhole piston apparatus in the run configuration, according an embodiment of this disclosure.

FIG. 3A illustrates a close-up view of FIG. 2 focusing on the chamber portion of the hydrostatically actuable downhole piston apparatus, depicted in the run position. The hydrostatically actuable piston 210 is exposed on one side to an initiation chamber 330 formed between portions of the hydrostatic mandrel 220, piston 210, and the bottom sub 370. The initiation chamber 330 is initially closed off to the wellbore annulus fluid by a rupture disc 320 (port isolation device) that is housed in the bottom sub 370. The initiation chamber 330 may be at atmospheric pressure (at the surface) or may be evacuated by pulling a vacuum. The burst pressure of the rupture disc 320 may be set higher than the anticipated hydrostatic pressure at the setting depth.

The other side of the hydrostatic piston 210 is exposed to a primary chamber 340 that may be at atmospheric pressure or may be evacuated by pulling a vacuum. According to the present disclosure, glide spacers 350 are disposed within the primary chamber 340 so as to mitigate deflection of the hydrostatically actuable piston 210 and the hydrostatic mandrel 220.

Initially, relative movement between the hydrostatically actuable piston 210 and the hydrostatic mandrel 220 is opposed by a shear screw 380 that couples a portion of the piston 210 to the bottom sub 370. The shear screw 380 operates as a safety mechanism preventing the packer from setting upon premature rupture of the rupture disc 320.

When the packer is lowered to the desired wellbore depth, the pressure in the annulus is raised or reaches a predetermined level and the rupture disc 320 ruptures allowing pressure communication between the annulus and the initiation chamber 330 to start driving the piston 210. The initial movement of the piston 210 shears the shear screw 380 allowing the pressure difference between the initiation chamber 330 and the primary chamber 340 to shift the piston 210 longitudinally relative to the hydrostatic mandrel 220 and toward the packer mandrel 230.

Figure 3B:
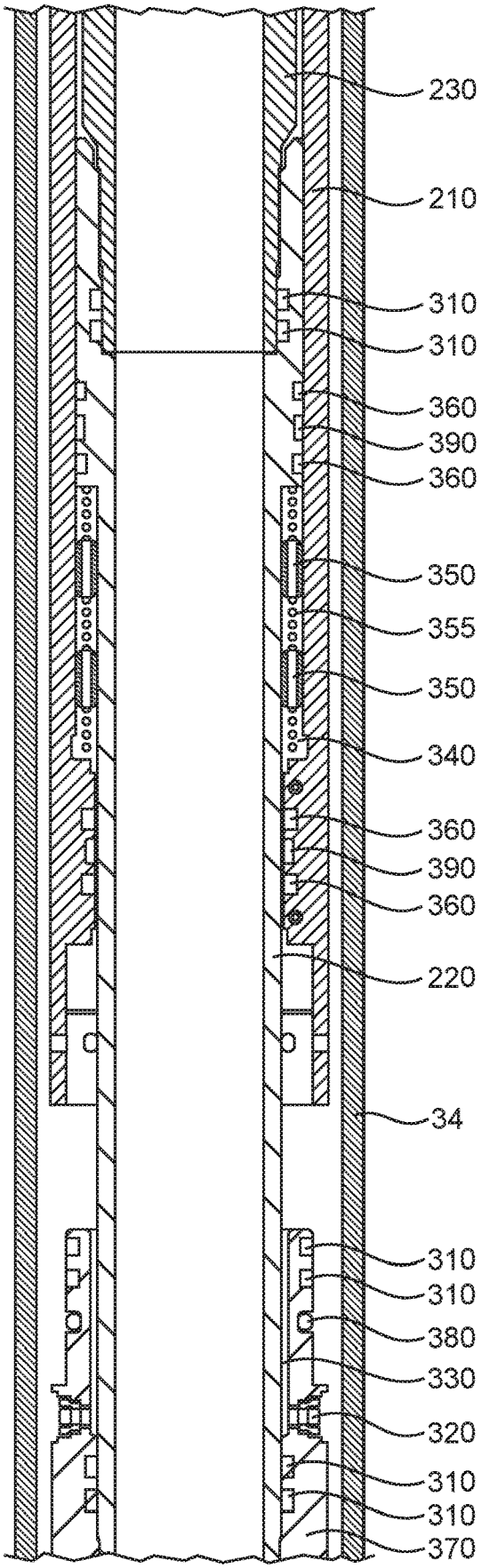
FIG. 3B is a close-up view of the same portion of the packer shown in FIG. 3A, with the hydrostatically actuable downhole piston apparatus in the set configuration, according to an embodiment of this disclosure.

FIG. 3B illustrates a close-up view of the same portion of the packer shown in FIG. 3A, but with the hydrostatically actuable downhole piston apparatus depicted in the set position. As shown in FIG. 3B, the hydrostatically actuable piston 210 has shifted longitudinally toward the packer mandrel 230 (as well as the seal and slip assemblies) and away from the bottom sub 370 in response to the pressure difference between the initiation chamber 330 and the primary chamber 340.

Figure 4A:
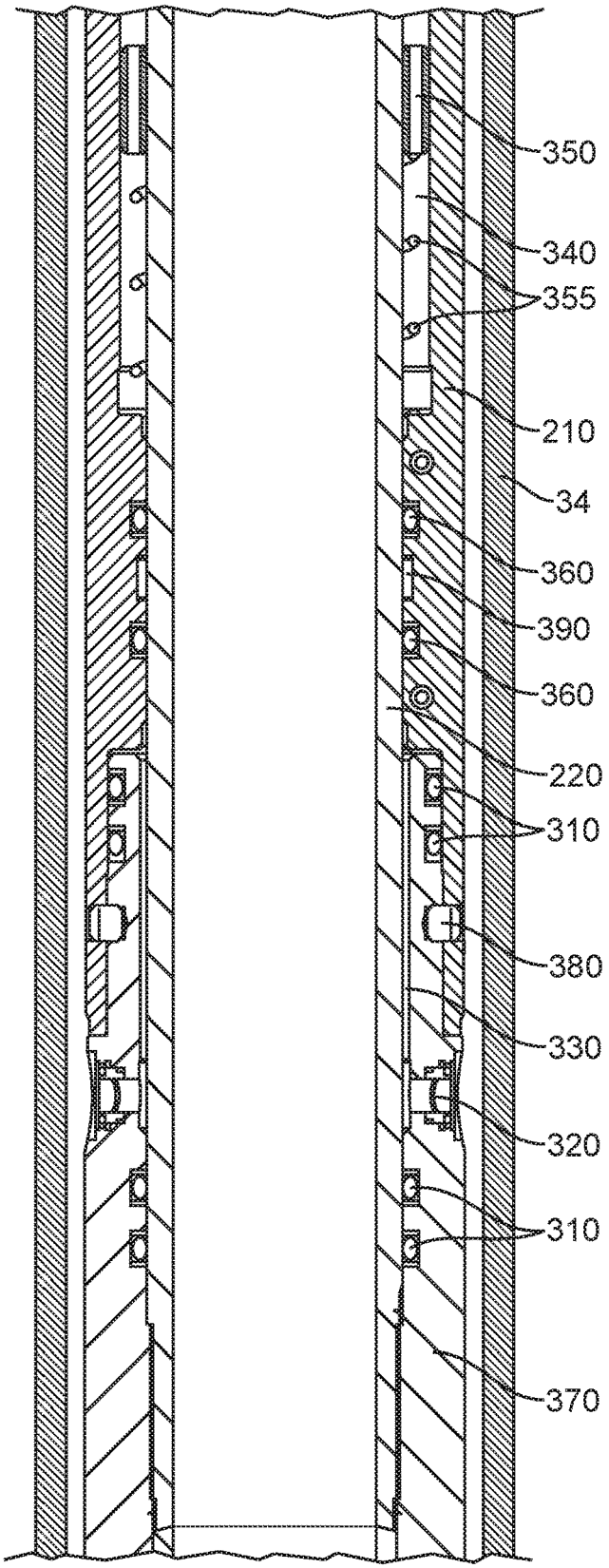
FIG. 4A is a close-up view of the portion of the packer shown in FIG. 3A, focusing on the downhole portion of the hydrostatically actuable downhole piston apparatus in the run configuration, according to an embodiment of this disclosure.

FIG. 4A illustrates a close-up view of the lower portion of FIG. 3A, focusing on the downhole portion of the hydrostatically actuable piston 210 in the run position. The initiation chamber 330 is formed between portions of the hydrostatic mandrel 220, piston 210, and the bottom sub 370. Seals 310 are located between bottom sub 370 and piston 210, as well as between the hydrostatic mandrel 220 and the bottom sub 370, to provide a sealing relationship between the hydrostatic mandrel 220, piston 210, and the bottom sub 370.

A third set of seals 360, operable to seal the hydrostatic mandrel 220 and piston 210, are located longitudinally between the initiation chamber 330 and the primary chamber 340. In between these seals 360, a centralizer ring 390 serves to properly position the piston 210 about the hydrostatic mandrel 220 and to help form a uniformly shaped chamber.

Seals 310, 360 may consist of any suitable sealing element or elements, such as a single O-ring, a plurality of O-rings, and/or a combination of backup rings, O-rings, and the like. Seals 310, 360 and/or centralizer rings 390 may comprise AFLAS® O-rings with PEEK back-ups for severe downhole environments, Viton O-rings for low temperature service, nitrile or hydrogenated nitrile O-rings for high pressure and temperature service, or a combination thereof.

The initiation chamber 330 is separated from the wellbore annulus by the rupture disc 320 (port isolation device) housed in the bottom sub 370. Initial movement of the piston 210 is opposed by the shear screw 380 which couples a portion of the piston 210 to the bottom sub 370.

It should be recognized by those skilled in the art that other port isolation devices may be used to communicate pressure in the annulus to the piston, such devices being considered within the scope of the present disclosure. Additionally, it should be recognized by those skilled in the art that other mechanisms for hydrostatically actuating the hydrostatically actuable piston may utilized, including the use of release assemblies that are actuated by the profile of the wellbore, including but not limited to the use of a collet assembly. Further, it should be recognized by those skilled in the art that a shear screw is optional and that the present disclosure is equally well-suited for use in the absence of a shear screw.

Figure 4B:
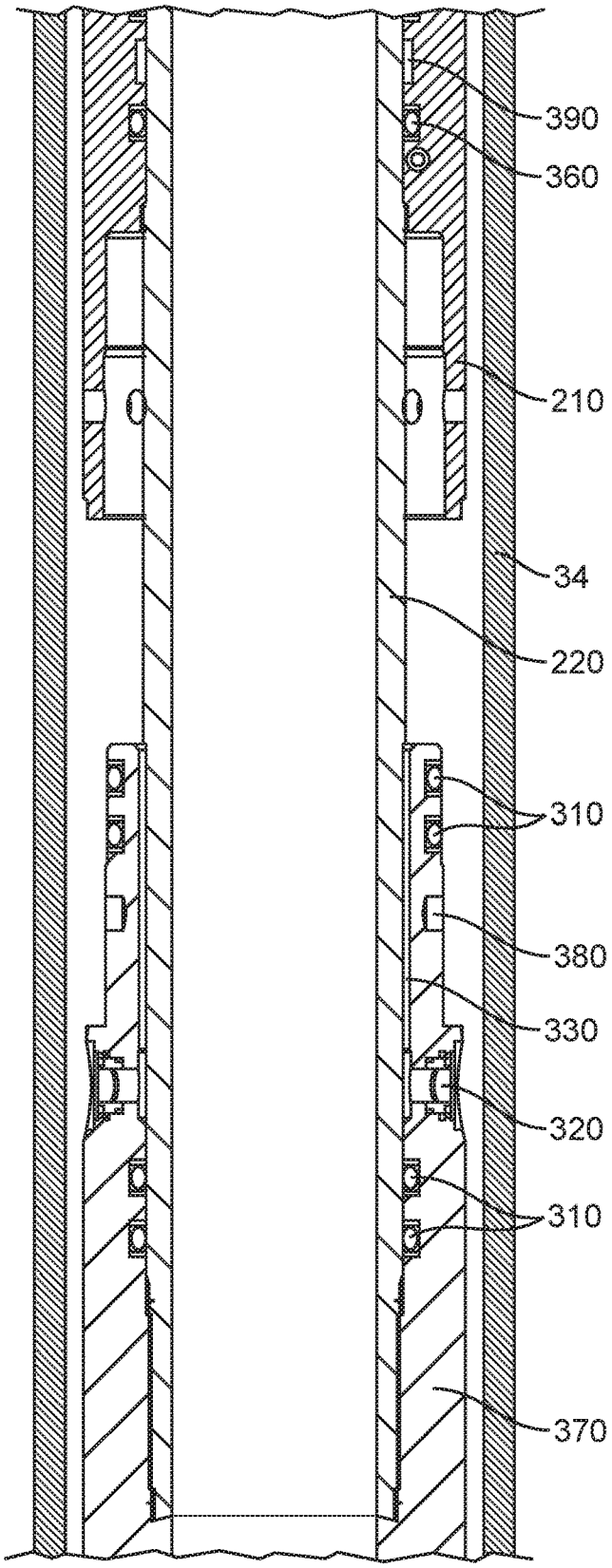
FIG. 4B is a close-up view of the same portion of the packer shown in FIG. 4A, with the hydrostatically actuable downhole piston apparatus in the set configuration, according to an embodiment of this disclosure.

FIG. 4B illustrates a close-up view of the same portion of the packer shown in FIG. 4A, but with the hydrostatically actuable downhole piston apparatus depicted in the set position. As shown in FIG. 4B, the shear screw 380 has been sheared and the hydrostatically actuable piston 210 has shifted longitudinally uphole.

Figure 5A:
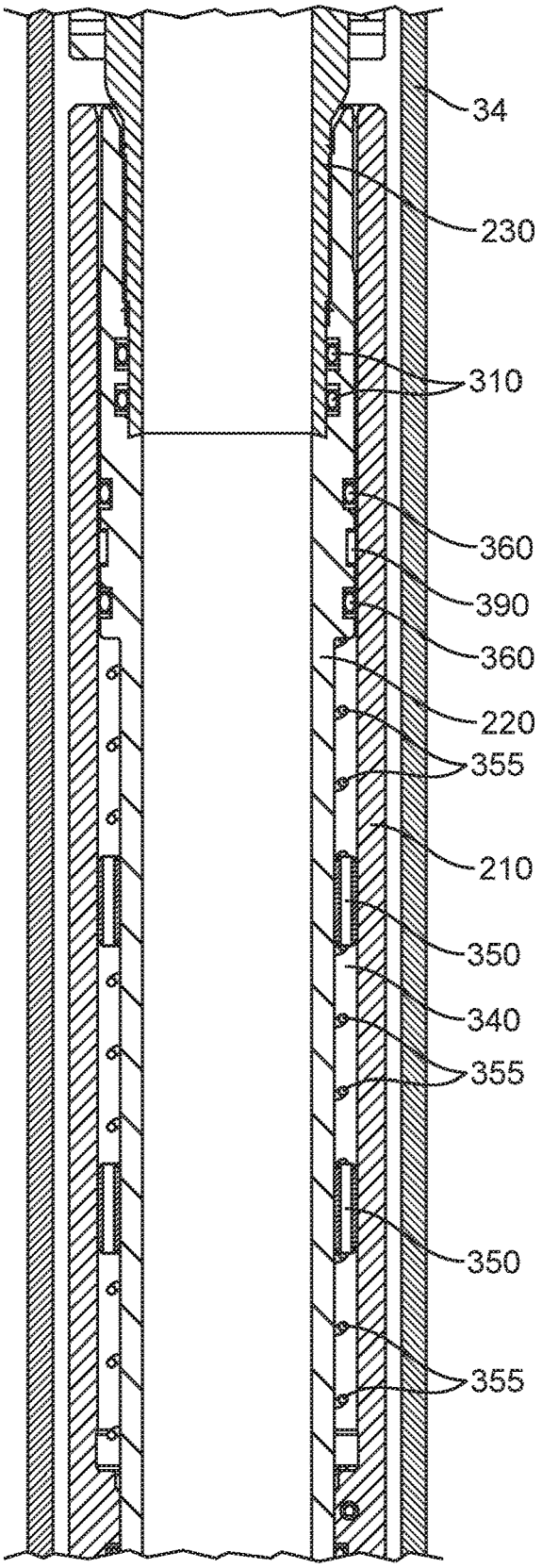
FIG. 5A is a close-up view of the portion of the packer shown in FIG. 3A, focusing on the glide spacer design of the uphole portion of the hydrostatically actuable downhole piston apparatus in the run configuration, according to an embodiment of this disclosure.

FIG. 5A illustrates a close-up view of FIG. 3A, focusing on the design of the glide spacers 350 positioned in the primary chamber 340, with the hydrostatically actuable piston 210 in the run position. The glide spacers 350 are spaced so as to provide for much shorter unsupported intervals of the piston 210 and hydrostatic mandrel 220 while providing for low friction movement of the hydrostatic piston 210 relative to the hydrostatic mandrel 220 when the glide spacers 350 are in full contact with the deflecting piston 210 and hydrostatic mandrel 220.

The glide spacers 350 in the illustrated embodiment are annular, substantially surrounding the hydrostatic mandrel 220. In other instances, rather than encircling the hydrostatic mandrel 220, the glide spacers 350 can extend a portion of the distance. In other examples, a the glide spacers 350 can be provided as a plurality of smaller individual arcuate pucks spaced about the hydrostatic mandrel 220.

Optionally, the glide spacers 350 may include a passageway providing pressure communication between different portions of the primary chamber 340 otherwise separated by the glide spacers 350. The glide spacers 350 may also optionally be maintained in position prior to longitudinal movement of the piston 210 by one or more springs 355 or other retainer system. Optionally, the retainer system may be capable of contracting or otherwise allowing the glide spacers 350 to move within the primary chamber 340 so as to not impede the setting stroke of the hydrostatically actuable piston 210.

The glide spacers 350 have a thickness sufficient to resist deflection of the hydrostatic piston 210 toward the hydrostatic mandrel 220 for at least a portion of the radial thickness of the primary chamber 340. In some cases, the glide spacer 350 may have a radial thickness essentially equal to the radial thickness of the primary chamber 340.

While two glide spacers 350 are shown in FIG. 5A, it should be understood by one skilled in the art that fewer or more numerous glide spacers 350 may be used according to this disclosure, so long as the glide spacers 350 provide sufficient support such that deflection of the piston 210 and hydrostatic mandrel 220 is mitigated under wellbore hydrostatic pressures. For instance, in some cases, a single glide spacer 350 in the primary chamber 340 may be sufficient. Alternatively, a plurality of glide spacers 350 in the primary chamber 340 may be necessary to support the piston 210 and hydrostatic mandrel 220, for example 2-6 glide spacers, depending on the degree of expected hydrostatic pressures or length of the primary chamber 340.

The glide spacers 350 may be made of any material that provides for low friction movement of the hydrostatically actuable piston 210 relative to the hydrostatic mandrel 220 when the glide spacers 350 are in full contact with the deflecting piston 210 and hydrostatic mandrel 220 and that is further capable of spacing apart the hydrostatic piston 210 and hydrostatic mandrel 220 under hydrostatic pressures characteristic of the wellbore. Suitable materials may include, but are not limited to, PEEK, glass-filled PTFE (TFG), bronze-filled PTFE (TFB), nickel-filled PTFE (TFN), or any combination thereof. Various hydrocarbon based lubricants may be provided in the primary chamber 340 or on the glide spacers 350 to facilitate sliding of the glide spacers 350.

Figure 5B:
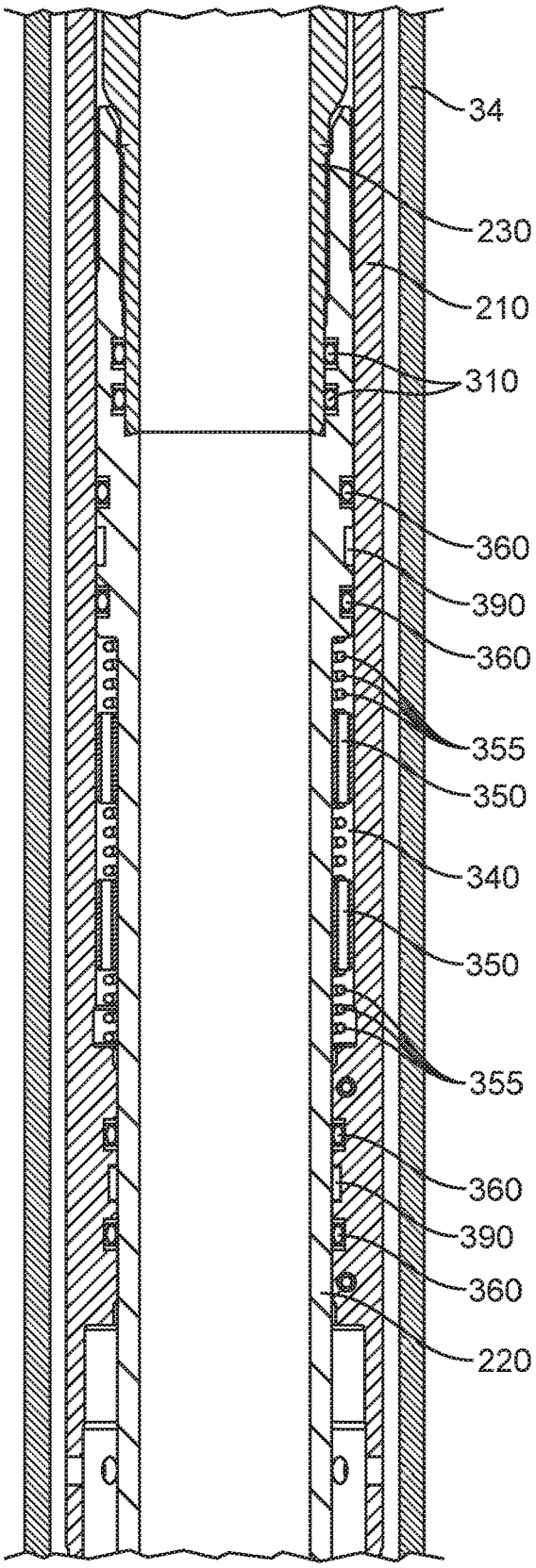
FIG. 5B is a close-up view of the same portion of the packer shown in FIG. 5A, with the hydrostatically actuable downhole piston apparatus in the set configuration, according to an embodiment of this disclosure.

FIG. 5B illustrates a close-up view of the same portion of the packer shown in FIG. 5A, with the hydrostatically actuable piston apparatus depicted in the set configuration. As shown in FIG. 5B, the piston 210 and the glide spacers 350 have shifted longitudinally in the uphole direction, toward the packer mandrel 230. The longitudinal movement of the glide spacers 350 provides for low friction movement of the hydrostatic piston 210 relative to the hydrostatic mandrel 220 when the glide spacers 350 are in full contact with the deflecting piston 210 and hydrostatic mandrel 220.

Figure 6A:
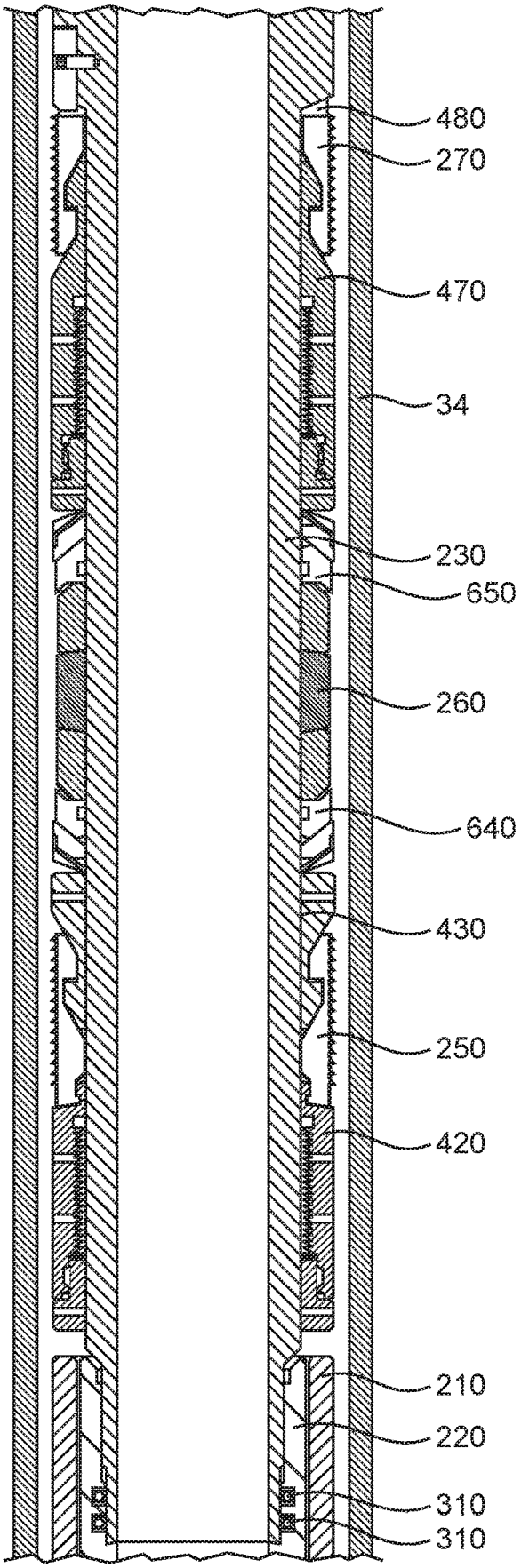
FIG. 6A is a close-up view of FIG. 2 focusing on the slip and seal assemblies of the packer including a hydrostatically actuable downhole piston apparatus in the run configuration, according to an embodiment of this disclosure.

FIG. 6A illustrates a close-up view of FIG. 2 focusing on the slip assembly 250, 270 and seal assembly 260 portion of the hydrostatically actuable downhole piston apparatus, depicted in the run position. As shown in FIG. 6A, when the apparatus is in the run configuration, the hydrostatically actuable piston 210 is spaced apart from the lower first wedge 420 disposed about the packer mandrel 230. The lower slip assembly 250 is located between the lower first wedge 420 and the lower second wedge 430. The lower first wedge 420 has a camming outer surface that is capable of engaging an inner surface of the lower slip assembly 250. The lower slip assembly 250 may have teeth located along its outer surface for providing a gripping arrangement with the interior of the well casing 34. As explained in greater detail below, when a compressive force is generated between the lower first wedge 420, lower slip assembly 250, and lower second wedge 430, by actuation of the hydrostatic piston 210, the lower slip assembly 250 radially extends into contact with the well casing 34, thereby setting the packer. It should be apparent to those skilled in the art that the slip assembly 250 and the lower first wedge 420 and the lower second wedge 430 may have a variety of different configurations including but not limited to having differently shaped wedge sections, different numbers of wedge sections, and/or slip assemblies of different designs, such configurations being considered within the scope of the present disclosure.

Substantially adjacent to the lower second wedge 430 is a lower element backup shoe 640 that is slidably positioned around the packer mandrel 230. Additionally, a seal assembly 260, depicted as three expandable seal elements, is slidably positioned around packer mandrel 230 between the lower element backup shoe 640 and the upper element backup shoe 650. In the illustrated embodiment, three expandable seal elements are shown, however, a seal assembly 260 according to the present disclosure may include any number of expandable seal elements.

The lower element backup shoe 640 and the upper element backup shoe 650 may be made from a deformable or malleable material, such as mild steel, soft steel, brass, and the like and may be thin cut at their distal ends. The ends of lower element backup shoe 640 and upper element backup shoe 650 may deform and flare outwardly toward the inner surface of the casing or formation during the setting sequence. In some cases, the lower element backup shoe 640 and the upper element backup shoe 650 form a metal-to-metal barrier between the packer and the inner surface of the casing.

Substantially adjacent to the upper element backup shoe 650 is a upper first wedge 470 that is disposed about the packer mandrel 230. The upper first wedge 470 has a camming outer surface that will engage an inner surface of the upper slip assembly 270. The upper slip assembly 270 is located between the upper first wedge 470 and the upper second wedge 480. In some cases, the upper slip assembly 270 may have teeth located along its outer surface for providing a gripping arrangement with the interior of the well casing. As explained in greater detail below, when a compressive force is generated between the upper first wedge 470, upper slip assembly 270, and upper second wedge 480, the upper slip assembly 270 is radially extended into contact with the well casing. As should be apparent to those skilled in the art, the upper slip assembly 270, the upper first wedge 470 and the upper second wedge 480 may have a variety of configurations including but not limited to having differently shaped wedge sections, different numbers of wedge sections, and/or slip assemblies of different designs, such configurations being considered within the scope of the present disclosure.

Upon actuation of the hydrostatically actuable piston 210, the hydrostatically actuable piston 210 shifts longitudinally to exert an upward force on the lower first wedge 420 causing the lower first wedge 420 to move upward towards the lower slip assembly 250. As the lower first wedge 420 contacts the lower slip assembly 250, the lower slip assembly 250 moves upwardly over the lower second wedge 430, which starts to set the lower slip assembly 250 against the inner surface of a setting surface, such as the casing 34.

As the lower slip assembly 250 extends outwardly toward the inner surface of the casing 34, it further moves upward causing an upward force on the lower second wedge 430 which in turn moves upward forcing the lower element backup shoe 640 to begin to move upward relative to the packer mandrel 230. As the piston 210, lower first wedge 420, lower slip assembly 250, lower second wedge 430, and lower element backup shoe 640 begin to move upward, the seal assembly 260, consisting of three expandable seal elements, begins to move upward and also begins to extend outwardly toward the casing 34.

In some cases, the upward movement of the seal assembly 260, consisting of expandable seal elements, forces the lower element backup shoe 640 and the upper element backup shoe 650 to flare outward toward the casing 34 to provide a metal-to-metal seal (not shown in FIG. 6A) in addition to the seal of the expandable seal elements between the casing 34 and the packer mandrel 230.

Upon the upward and sealingly movement of the lower element backup shoe 640, seal assembly 260, consisting of expandable seal elements, and upper element backup shoe 650, an upward force is transmitted to the upper first wedge 470 causing the upper first wedge 470 to contact the upper slip assembly 270. Once the upper first wedge 470 acts upon the upper slip assembly 270, the upper slip assembly 270 moves upwardly over the upper second wedge 480, which moves the upper slip assembly 270 outwardly against the inner surface of the casing 34, setting the packer.

Figure 6B:
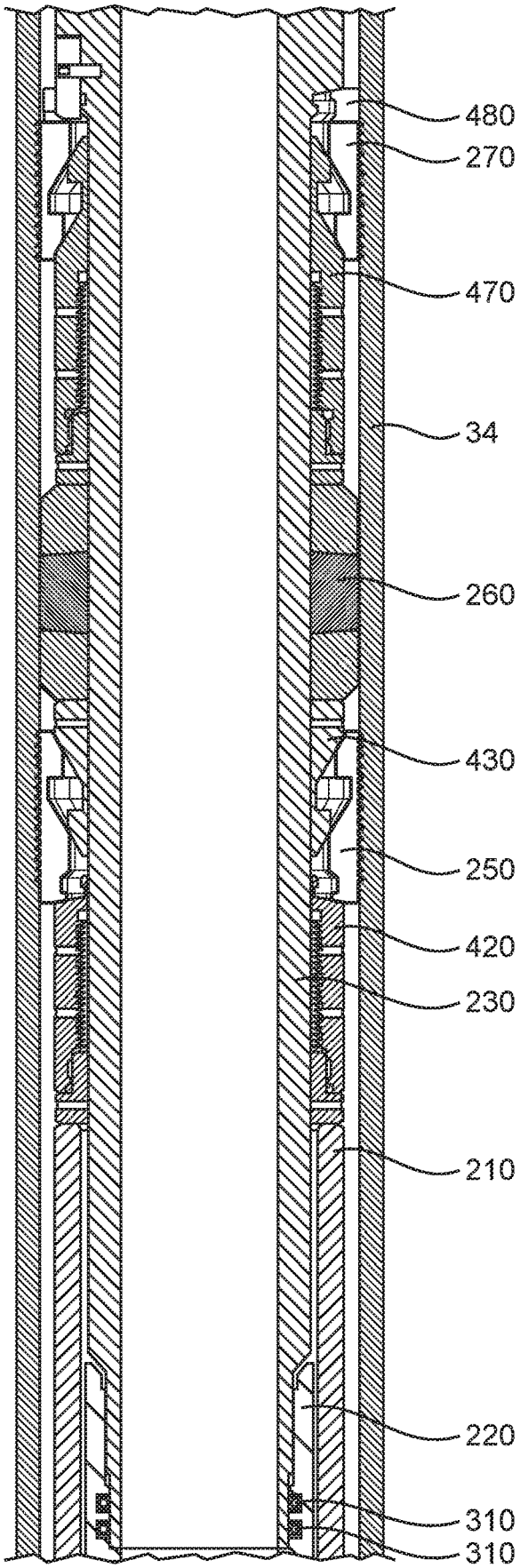
FIG. 6B is a close-up view of the same portion of the packer shown in FIG. 6A, with the hydrostatically actuable downhole piston apparatus in the set configuration, according to an embodiment of this disclosure.

FIG. 6B is a close-up view of the same portion of the packer shown in FIG. 6A, with the hydrostatically actuable downhole piston 210 apparatus in the set configuration. As depicted in FIG. 6B, the hydrostatic piston has shifted longitudinally toward the lower slip assembly 250, the seal assembly 260, and the upper slip assembly 270, thereby actuating the slip assemblies 250, 270 and seal assembly 260 to a radially expanded sealing position and setting the packer.

Numerous examples are provided herein to enhance understanding of the present disclosure. A specific set of examples are provided as follows.

In a first example, there is disclosed a hydrostatically actuable downhole piston apparatus including at least one mandrel having an internal bore, a hydrostatic piston slidably disposed about the mandrel and forming a sealed chamber between the mandrel and the hydrostatic piston, the chamber containing a glide spacer having a thickness sufficient to resist deflection of the hydrostatic piston toward the mandrel for at least a portion of the radial thickness of the chamber, wherein the hydrostatic piston has a first fixed configuration which responsive to an increase in pressure external to the chamber shifts longitudinally relative to the mandrel.

In a second example, an apparatus is disclosed according to the preceding example further including a slip assembly disposed on the mandrel having a radially extendible surface, wherein the surface extends responsive to the longitudinal shift of the hydrostatic piston.

In a third example, an apparatus is disclosed according to any of the preceding examples, further including a seal assembly disposed on the mandrel having a radially extendible seal, wherein the seal extends responsive to the longitudinal shift of the hydrostatic piston.

In a fourth example, an apparatus is disclosed according to any of the preceding examples, wherein the chamber is at a pressure equal to or below surface atmospheric pressure.

In a fifth example, an apparatus is disclosed according to any of the preceding examples, wherein the glide spacer has a radial thickness essentially equal to the radial thickness of the chamber.

In a sixth example, an apparatus is disclosed according to any of the preceding examples, wherein the glide spacer comprises a passageway providing pressure communication between different portions of the chamber otherwise separated by the glide spacer.

In a seventh example, an apparatus is disclosed according to any of the preceding examples, further including a plurality of glide spacers.

In an eighth example, an apparatus is disclosed according to any of the preceding examples, wherein the glide spacer is maintained in position prior to the longitudinal shifting of the piston by a retainer.

In a ninth example, an apparatus is disclosed according to any of the preceding examples, wherein the retainer comprises a spring.

In a tenth example, an apparatus is disclosed according to any of the preceding examples, wherein the glide spacer comprises at least one material selected from the group consisting of PEEK, glass-filled PTFE (TFG), bronze-filled PTFE (TFB), and nickel-filled PTFE (TFN).

In an eleventh example, a method of hydrostatically setting a downhole tool in a wellbore is disclosed, including running a downhole tool into the wellbore to a setting depth, wherein the downhole tool includes at least one mandrel having an internal bore, a hydrostatic piston slidably disposed about the mandrel and forming a sealed chamber between the mandrel and the hydrostatic piston, the chamber containing at least one glide spacer having a thickness sufficient to resist deflection of the hydrostatic piston toward the mandrel for at least a portion of the radial thickness of the chamber, wherein the hydrostatic piston has a first fixed configuration, and a slip assembly disposed on the mandrel having a radially extendible surface, and wherein responsive to an increase in hydrostatic pressure in the wellbore external to the chamber, the hydrostatic piston shifts longitudinally from its fixed configuration actuating the slip assembly to extend the extendible surface, thereby setting the downhole tool within the wellbore.

In a twelfth example, a method is disclosed according to any of the preceding examples, wherein the downhole tool is a packer.

In a thirteenth example, a method is disclosed according to any of the preceding examples, wherein the downhole tool further includes a seal assembly disposed on the mandrel having a radially extendible seal, wherein the seal extends responsive to the longitudinal shift of the hydrostatic piston.

In a fourteenth example, a method is disclosed according to any of the preceding examples, wherein the chamber is at a pressure equal to or below surface atmospheric pressure.

In a fifteenth example, a method is disclosed according to any of the preceding examples, wherein the at least one glide spacer has a radial thickness essentially equal to the radial thickness of the chamber.

In a sixteenth example, a method is disclosed according to any of the preceding examples, wherein the at least one glide spacer includes a passageway providing pressure communication between different portions of the chamber otherwise separated by the glide spacer.

In a seventeenth example, a method is disclosed according to any of the preceding examples, wherein the downhole tool further includes a plurality of glide spacers.

In an eighteenth example, a method is disclosed according to any of the preceding examples, wherein the at least one glide spacer is maintained in position prior to the longitudinal shifting of the piston by a retainer.

In a nineteenth example, a method is disclosed according to any of the preceding examples, wherein the retainer comprises a spring.

In a twentieth example, a method is disclosed according to any of the preceding examples, wherein the at least one glide spacer comprises at least one material selected from the group consisting of PEEK, glass-filled PTFE (TFG), bronze-filled PTFE (TFB), and nickel-filled PTFE (TFN).

In a twenty-first example, a hydrostatic pressure setting system is disclosed, including a downhole tool provided within a wellbore, the downhole tool including at least one mandrel having an internal bore, a hydrostatic piston slidably disposed about the mandrel and forming a sealed chamber between the mandrel and the hydrostatic piston, the chamber containing at least one glide spacer having a thickness sufficient to resist deflection of the hydrostatic piston toward the mandrel for at least a portion of the radial thickness of the chamber, wherein the hydrostatic piston has a first fixed configuration which responsive to an increase in pressure external to the chamber shifts longitudinally relative to the mandrel, a slip assembly disposed on the mandrel having a surface which radially extends in response to the longitudinal shift of the hydrostatic piston thereby setting the downhole tool within the wellbore.

In a twenty-second example, a system is disclosed according to any of the preceding examples, wherein the downhole tool is a packer.

In a twenty-third example, a system is disclosed according to any of the preceding examples, wherein the at least one glide spacer comprises a passageway providing pressure communication between different portions of the chamber otherwise separated by the glide spacer.

In a twenty-fourth example, a system is disclosed according to any of the preceding examples, wherein the downhole tool further includes a seal assembly disposed on the mandrel having a radially extendible seal, wherein the seal extends responsive to the longitudinal shift of the hydrostatic piston.

In a twenty-fifth example, a system is disclosed according to any of the preceding examples, wherein the chamber is at a pressure equal to or below surface atmospheric pressure.

In a twenty-sixth example, a system is disclosed according to any of the preceding examples, wherein the at least one glide spacer has a radial thickness essentially equal to the radial thickness of the chamber.

In a twenty-seventh example, a system is disclosed according to any of the preceding examples, wherein the downhole tool further includes a plurality of glide spacers.

In a twenty-eighth example, a system is disclosed according to any of the preceding examples, wherein the at least one glide spacer is maintained in position prior to the longitudinal shifting of the piston by a retainer.

In a twenty-ninth example, a system is disclosed according to any of the preceding examples, wherein the retainer comprises a spring.

In a thirtieth example, a system is disclosed according to any of the preceding examples, wherein the at least one glide spacer comprises at least one material selected from the group consisting of PEEK, glass-filled PTFE (TFG), bronze-filled PTFE (TFB), and nickel-filled PTFE (TFN).

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that a system including either one member of the set, or multiple members of the set, or all members of the set, satisfies the claim.

I claim:

1. A hydrostatically actuable downhole piston apparatus comprising:

a mandrel having an internal bore;

a hydrostatic piston slidably disposed about the mandrel and forming a sealed chamber between the mandrel and the hydrostatic piston, the chamber having a predetermined length; and at least one glide spacer disposed within the chamber and positioned substantially equidistant along the predetermined length so as to provide for a shorter unsupported portion or portions of the chamber along the predetermined length, the at least one glide spacer having a thickness sufficient to resist deflection of the hydrostatic piston toward the mandrel for at least a portion of the radial thickness of the chamber, wherein the hydrostatic piston has a first fixed configuration which responsive to an increase in pressure external to the chamber shifts longitudinally relative to the mandrel, and wherein the at least one glide spacer is operable to move longitudinally within the chamber when the piston shifts longitudinally.

2. The hydrostatically actuable downhole piston apparatus according to claim 1, further comprising a slip assembly disposed on the mandrel having a radially extendible surface, wherein the surface extends responsive to the longitudinal shift of the hydrostatic piston.

3. The hydrostatically actuable downhole piston apparatus according to claim 2, further comprising a seal assembly disposed on the mandrel having a radially extendible seal, wherein the seal extends responsive to the longitudinal shift of the hydrostatic piston.

4. The hydrostatically actuable downhole piston apparatus according to claim 1, wherein the chamber is at a pressure equal to or below surface atmospheric pressure.

5. The hydrostatically actuable downhole piston apparatus according to claim 1, wherein the at least one glide spacer has a radial thickness essentially equal to the radial thickness of the chamber.

6. The hydrostatically actuable downhole piston apparatus according to claim 1, wherein the at least one glide spacer comprises a passageway providing pressure communication between different portions of the chamber otherwise separated by the glide spacer.

7. The hydrostatically actuable downhole piston apparatus according to claim 1, further comprising a plurality of glide spacers, the plurality of glide spacers spaced about the mandrel substantially equidistant along the predetermined length.

8. The hydrostatically actuable downhole piston apparatus according to claim 1, wherein the glide spacer is maintained in position prior to the longitudinal shifting of the piston by a retainer, the retainer further operable to contract or otherwise allow the at least one glide spacer to move within the chamber so as to not impede longitudinal shifting of the piston.

9. The hydrostatically actuable downhole piston apparatus according to claim 8, wherein the retainer comprises a spring.

10. The hydrostatically actuable downhole piston apparatus according to claim 8, wherein the glide spacer comprises at least one material selected from the group consisting of PEEK, glass-filled PTFE (TFG), bronze-filled PTFE (TFB), and nickel-filled PTFE (TFN).

11. The hydrostatically actuable downhole piston apparatus according to claim 1, wherein the glide spacer is in contact with the hydrostatic piston and the mandrel.

12. The hydrostatically actuable downhole piston apparatus according to claim 1, further comprising an upper glide spacer and a lower glide spacer spaced apart along the chamber and positioned substantially equidistant along the predetermined length of the chamber.

13. A method of hydrostatically setting a downhole tool in a wellbore, comprising:

running the downhole tool into the wellbore to a setting depth, wherein the downhole tool comprises:

at least one mandrel having an internal bore;

a hydrostatic piston slidably disposed about the mandrel and forming a sealed chamber between the mandrel and the hydrostatic piston, the chamber having a predetermined length and containing at least one glide spacer disposed within the chamber and positioned substantially equidistant along the predetermined length so as to provide for a shorter unsupported portion or portions of the chamber along the predetermined length, the at least one glide spacer having a thickness sufficient to resist deflection of the hydrostatic piston toward the mandrel for at least a portion of the radial thickness of the chamber, wherein the hydrostatic piston has a first fixed configuration; and a slip assembly disposed on the mandrel having a radially extendible surface, and wherein responsive to an increase in hydrostatic pressure in the wellbore external to the chamber, the hydrostatic piston shifts longitudinally from its fixed configuration actuating the slip assembly to extend the extendible surface, thereby setting the downhole tool within the wellbore, wherein the at least one glide spacer is operable to move longitudinally within the chamber when the piston shifts longitudinally.

14. The method according to claim 13, wherein the downhole tool is a packer.

15. The method according to claim 13, wherein the at least one glide spacer comprises a passageway providing pressure communication between different portions of the chamber otherwise separated by the glide spacer.

16. The method according to claim 13, wherein the at least one glide spacer is maintained in position prior to the longitudinal shifting of the piston by a retainer.

17. The method according to claim 16, wherein the retainer comprises a spring.

18. The method according to claim 13, wherein the at least one glide spacer comprises at least one material selected from the group consisting of PEEK, glass-filled PTFE (TFG), bronze-filled PTFE (TFB), and nickel-filled PTFE (TFN).

19. The method according to claim 13, further comprising evacuating the chamber by pulling a vacuum when the hydrostatic piston is in the first fixed configuration.

20. A hydrostatic pressure setting system comprising:

a downhole tool provided within a wellbore, the downhole tool comprising:

at least one mandrel having an internal bore;

a hydrostatic piston slidably disposed about the mandrel and forming a sealed chamber between the mandrel and the hydrostatic piston, the chamber having a predetermined length and containing at least one glide spacer disposed within the chamber and positioned substantially equidistant along the predetermined length so as to provide for a shorter unsupported portion or portions of the chamber along the predetermined length, the at least one glide spacer having a thickness sufficient to resist deflection of the hydrostatic piston toward the mandrel for at least a portion of the radial thickness of the chamber, wherein the hydrostatic piston has a first fixed configuration which responsive to an increase in pressure external to the chamber shifts longitudinally relative to the mandrel; and a slip assembly disposed on the mandrel having a surface which radially extends in response to the longitudinal shift of the hydrostatic piston thereby setting the downhole tool within the wellbore, wherein the at least one glide spacer is operable to move longitudinally within the chamber when the piston shifts longitudinally.

21. The system according to claim 20, wherein the downhole tool is a packer.

22. The system according to claim 20, wherein the at least one glide spacer comprises a passageway providing pressure communication between different portions of the chamber otherwise separated by the glide spacer.

* * * * *